United States Patent [19]

Rohrbough

[11] Patent Number: 5,060,704

[45] Date of Patent: Oct. 29, 1991

[54] SUCTION TRANSFER ASSEMBLY

[75] Inventor: John Rohrbough, Walnut, Calif.

[73] Assignee: David Bull Laboratories Pty. Ltd., Victoria, Australia

[21] Appl. No.: 529,203

[22] Filed: May 25, 1990

[51] Int. Cl.[5] ..... B65B 1/04

[52] U.S. Cl. ..... 141/312; 141/329; 141/300

[58] Field of Search ..... 141/27, 97, 312, 329, 141/330, 346, 347, 352, 353, 354; 604/88, 89, 403, 407, 411, 414, 415, 416, 905, 206, 408

[56] References Cited

U.S. PATENT DOCUMENTS 4,169,475 10/1979 Genese ..... 128/272.3

4,535,820 8/1985 Raines ..... 137/854

*Primary Examiner*—Henry J. Recla

*Assistant Examiner*—David Walczok

*Attorney, Agent, or Firm*—Darby & Darby

[57] ABSTRACT

Suction transfer assembly for a medicament liquid, formed of a vial having a chamber filled with the liquid and an open end closed by a penetrable stopper on which the vial is slidable longitudinally, and an adapter having a front end with a nozzle lockably connectable to a mechanical probe-containing counterpart nozzle of a suction device, e.g. a syringe, a rear end with a hollow needle, and an internal flow path therebetween. The adapter rear end is insertable into the vial open end and fastenable to the stopper for penetrating the stopper by the needle. The adapter front end has a mechanical probe-openable and self-closing check valve in the flow path adjacent the nozzle so that on locking the counterpart nozzle thereto, its probe opens the valve for suction transfer of liquid from the vial to the device and simultaneous compensating vial movement relative to the stopper under external atmospheric pressure to reduce the chamber volume by an amount generally equal to the liquid transferred.

21 Claims, 2 Drawing Sheets

SUCTION TRANSFER ASSEMBLY

FIELD AND BACKGROUND OF THE INVENTION

The present invention relates to a suction transfer assembly of a vial having a chamber filled with a medicament liquid, such as a hazardous liquid, and closed by a stopper on which the vial is longitudinally slidable, and a flow path containing adapter connectable to the vial by a hollow needle that penetrates the stopper, usable with a suction operating dispenser device, e.g. a syringe, lockably connectable to the adapter at a check valve in the flow path to transfer liquid from the vial to the device, with simultaneous compensating vial movement relative to the stopper under external atmospheric pressure to reduce the chamber volume by an amount equal to the liquid transferred, yet preventing leakage from the adapter on disconnecting the device.

Devices that hold and dispense hazardous materials, such as hazardous liquids in the medical field, are dangerous to use due to possible leakage from the device and contamination of the environment or user. Among such hazardous materials are cytotoxic or antineoplastic (oncology) drugs administered in chemotherapeutic treatment of cancer. They are usually stored as an injectable solution in a stoppered vial, prone to aerosol or droplet formation, as when manipulated at differential pressures in withdrawing a dosage into a syringe, since these operations change the saturated vapor pressure conditions of the volatilized constituents in the air space above the solution in the vial.

U.S. Pat. Nos. 4,768,568 and 4,834,149 to Fournier et al show a hazardous material vial apparatus and conjoint operating method, in which the neck of a vial closed by a stationary stopper and containing a small amount of hazardous material powder and captive air is enclosed by a coaxial snap-on pressure release housing, formed as an open ended hollow cylinder whose outer end is closed by a septum and whose inner end openly faces the stopper, and which has an air pressure releasing hydrophobic filter vent near its outer end and a shiftable piston that divides the cylinder into an outer atmospheric chamber containing the vent and an inner pressure chamber openly facing the stopper.

According to these two patents, the needle of a syringe penetrates the septum, piston and stopper to add a small amount of liquid to the powder to form a hazardous solution and a saturated vapor thereof at increased pressure in the air space above the solution due to the added liquid volume. On inverting the arrangement, the increased pressure refills the syringe with the solution and returns the vial to atmospheric pressure. As the needle is removed, any escaping solution and aerosol formed from the vapor under the differential pressure conditions are retained in the inner chamber while the piston move outwardly to adjust this chamber to atmospheric pressure, or are retained by the hydrophobic vent if they reach the outer chamber.

Alternatively, according to these patents, if the solution is not used immediately, the arrangement is kept upright, enough air is drawn into the syringe to return the vial to atmospheric pressure, and the needle removed as before, but with the air in the syringe being discharged into the outer chamber for safe exit into the atmosphere while any hazardous solution and aerosol are retained by the hydrophobic vent. When the solution is to be used, the syringe is loaded with a volume of air equal to that of the solution to be removed, this air is charged to the vial to increase its air pressure, the arrangement inverted, the solution volume drawn into the syringe and the vial returned to atmospheric pressure, and the needle removed as before.

It would be desirable to provide a suction transfer assembly for a medicament liquid, especially a hazardous liquid, that permits safe and easy transfer of the liquid from its container to a suction operating dispenser device such as a syringe, yet avoids leakage on detaching the device from the assembly.

SUMMARY OF THE INVENTION

It is an object of the invention to provide a suction transfer assembly for a medicament liquid, e.g. a hazardous liquid, permitting its repeated safe and easy transfer in selective dosage amounts from a container to a suction operating dispenser device without leakage on detaching the device each time from the assembly.

According to the invention, a suction transfer assembly for a medicament liquid, such as a hazardous liquid, is provided which comprises a longitudinal vial and a longitudinal adapter.

The vial forms an enclosed longitudinal chamber filled with the medicament liquid and has an open end closed by a penetrable stopper. The vial is slidable longitudinally relative to the stopper and the stopper slidably seals the liquid in the chamber in any position of vial sliding movement. Desirably, the liquid filled vial chamber is substantially free from air spaces. Also, the stopper has fastening means facing the vial open end.

The adapter has a front end, a rear end and an internal flow path extending therethrough. The rear end has a rearwardly facing hollow needle with a pointed tip defining the flow path rear terminus, and counterpart fastening means to the stopper fastening means. The rear end is insertable into the vial open end to fasten the adapter fastening means to those of the stopper to fasten the adapter to the stopper, and to penetrate the stopper by the needle to connect the chamber and flow path.

The adapter front end has a forwardly facing hollow nozzle defining the flow path front terminus, a mechanical contact probe-openable and self-closing check valve in the flow path adjacent the nozzle, and a lock connector, e.g. a luer lock, adapted to lock releasably to a counterpart lock connector, e.g. a counterpart luer lock, on a separate suction operated dispenser device, e.g. a syringe, having a counterpart hollow nozzle containing a mechanical contact probe to connect with the nozzle and open the valve.

On fastening the adapter fastening means to the stopper fastening means and penetrating the stopper by the needle, and locking the device lock connector to the adapter lock connector and connecting the device nozzle with the adapter nozzle and mechanically opening the valve by the contact probe, suction operation of the device will cause liquid transfer from the chamber via the adapter to the device and simultaneous compensating vial movement longitudinally relative to the stopper under external atmospheric pressure to reduce the chamber volume by an amount generally equal to the liquid transferred.

The adapter rear end may have a socket containing the needle with its tip located inwardly from the rear end, and also containing its fastening means. The adapter and stopper fastening means may be coacting thread connection means. Coacting separation inhibiting means may be provided on the adapter and stopper to inhibit their separation once they are fastened.

The vial, stopper and adapter are suitably of generally cylindrical shape and coaxially arranged, With the needle located centrally in the adapter. The liquid filled vial closed by the stopper, and the adapter, may be in the form of a packaged kit.

The invention also contemplates the method of using the assembly for essentially leakage free transfer of a selective volume of the medicament from the vial chamber via the adapter to the separate suction operated device, comprising the steps of (a) fastening the adapter fastening means to those of the stopper and penetrating the stopper by the needle to fasten the adapter to the stopper and flow connect the vial chamber and adapter flow path, (b) locking the device lock connector to that of the adapter to flow connect the device nozzle with the adapter nozzle and mechanically open the adapter check valve by the device contact probe to flow connect the device with the adapter flow path, (c) transferring a selective volume of liquid from the vial chamber into the device by suction operation of the device and simultaneously effecting compensating vial movement longitudinally relative to the stopper under external atmospheric pressure to reduce the chamber volume by an amount generally equal to the liquid transferred, and (d) disconnecting the device from the adapter by unlocking their lock connectors with accompanying self-closing of the check valve to prevent liquid leakage from the adapter nozzle.

Steps (b), (c) and (d) may be repeated to transfer further selective volumes of liquid from the vial chamber to the device.

BRIEF DESCRIPTION OF THE DRAWINGS

Other objects of the invention will become apparent from the within specification and accompanying drawings, in which.

DESCRIPTION OF THE PREFERRED EMBODIMENTS

Figure 1:
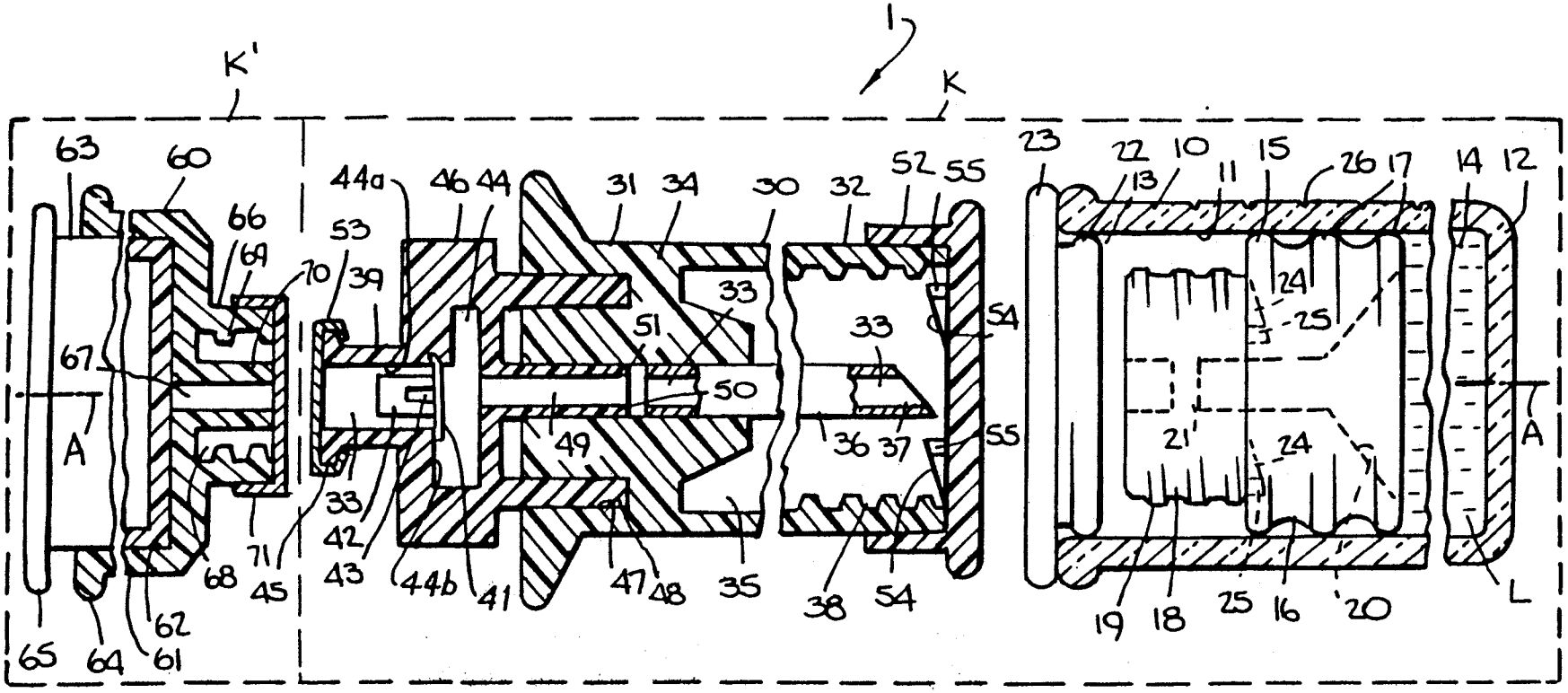
FIG. 1 is a schematic sectional view of a suction transfer assembly according to an embodiment of the invention, showing the stoppered vial and adapter in unassembled condition, and an associated syringe as suction operating dispensing device.

Referring to the drawings, and initially to FIG. 1, a suction transfer assembly 1 is shown, including a vial 10 and an adapter 30, plus an associated suction operating or aspirating dispensing device in the form of a conventional syringe 60.

Vial 10 is shaped as a hollow longitudinal, e.g. glass, cylinder with a round cross sectional longitudinal inside wall 11 between its closed rear end 12 and open front end 13, to form an enclosed longitudinal chamber 14 filled with a medicament liquid L, such as a hazardous liquid, open end 13 being closed by a penetrable stopper Vial 10 is slidable longitudinally relative to stopper 15 while stopper 15 slidably seals liquid L in chamber 14 in any position of vial sliding movement.

Stopper 15 is shaped as a corresponding solid, e.g. rubber, cylinder With a round cross sectional body 16 having seal rings or ridges 17 slidably sealingly engaging vial wall 11 in the manner of a piston, and a round cross sectional extension 18 facing vial open end 13 and having fastening means formed by external threads 19, plus a central bore 20 closed by an internal penetrable seal 21 adjacent the front of extension 18.

Vial 10 is filled with liquid L to a maximum level yet sufficiently spaced inwardly from open end 13 to accommodate stopper 15 therein. Vial 10 is filled in a manner avoiding the presence of air spaces or pockets in chamber 14, to permit the liquid to undergo unhindered suction transfer or aspiration via stopper bore 20 on penetrating seal 21, as later described.

Vial 10 may have a bead 22 to engage a cap 28 on open end 13 to preserve vial 10 and stopper 15 in sterile condition.

The base of stopper extension 18 may have a circumferential formation of ratchets 24 and associated recesses 25 at the inner end of threads 19 for the purposes described below.

The volume of liquid L in chamber 14, in terms of the relative longitudinal position of vial 10 on stopper 15, is indicated by a series of indicia 26 along the barrel of vial 10. Liquid L may be a standard hazardous material medicament solution, e.g. an injectable antineoplastic (oncology) solution.

Adapter 30 is shaped as a longitudinal, partially hollow, round cross sectional, e.g. rigid plastic, cylinder, with a front end 81 and rear end 82, and an internal flow path 38 extending through its body 34. Rear end 32 has a rearwardly opening socket 35 that contains a rearwardly facing hollow needle 86 with a pointed tip 37 defining the rear terminus of flow path 33, and counterpart fastening means formed by internal threads 38 that coact with external threads 19 on stopper 15. Rear end 32 is insertable into vial open end 13 and rotatable to fasten threads 38 to threads 19 to fasten adapter 30 to stopper 15, and simultaneously to cause needle 36 to enter stopper bore 20 and its tip 37 to penetrate seal 21 to connect chamber 14 and flow path 33.

Adapter front end 81 has a forwardly facing hollow nozzle 39 defining the front terminus of flow path 33. A mechanical contact probe-openable and self-closing check valve 40 is located in flow path 33 adjacent nozzle 39. Valve 40 is formed of a resilient diaphragm 41 having a forwardly facing hollow tubular nose 42 provided with liquid inflow apertures 43, and is situated in a valve chamber 44 with one edge portion of diaphragm 41 rigidly hingedly seated on the axially extending interior wall 44*a* of chamber 44.

Nose 42 projects into the internal bore of nozzle 89 and diaphragm 41 seats sealingly against the adjacent wall 44*b* of chamber 44 as valve seat at the entrance to that bore when valve 40 is in normally self-closed position, yet on inserting a mechanical contact probe into the bore of nozzle 39, nose 42 is contacted thereby and urged inwardly to lift diaphragm 41 from seated position to open valve 40 (shown in phantom in FIG. 1).

Nozzle 39 has a lock connector formed by an external luer lock 45, adapted to lock releasably to a counterpart lock connector, formed by an internal luer lock, on a separate suction operated dispenser device, e.g. syringe 60, having a counterpart hollow nozzle containing such a mechanical contact probe arranged to flow connect with nozzle 39 and open valve 40.

Nozzle 39, valve 40, diaphragm 41, nose 42, apertures 43, chamber 44 and luer lock 45, may be formed as a separate commercial add-on unit 46 (as, for example, a valve unit of the type shown in U.S Pat. No. 4,535,820). mounted in an annular recess 47 in body 34 at front end 31 via its hollow annular shank 48, and with the bore 49 in its central extension 50 communicating with the inner end of needle 86 at interface 51 to provide this part of flow path 33 in adapter 30.

Adapter 30 may have a cap 52 on r®ar end 32 and a cap 53 on nozzle 39 to preserve it in sterile condition.

The outer edge of rear end 82 may have a circumferential counterpart formation of ratchets 54 and associated bosses 55 at the outer end of threads 38 in socket 85 arranged to coact with the formation of ratchets 24 and associated recesses 25 on stopper 15 for a locking grip between these parts when adapter 30 is rotated onto stopper 15 to achieve their interconnection and the penetrating of seal 21 by needle tip 37. As adapter threads 38 reach full rotational engagement with stopper threads 19, adapter ratchets 54 engage stopper ratchets 24 and adapter bosses 55 snap-lock in stopper recesses 25, respectively, such ratchets, bosses and recesses thus forming coacting separation inhibiting means to prevent separation of adapter 80 from stopper 15.

Syringe 60 is a conventional suction operated dispenser device of the type usable with assembly I, having a hollow cylinder 61 whose chamber 62 slidably sealingly receives a piston plunger 63 for reciprocation by finger manipulation of cylinder flange 64 and plunger flange 65, plus a hollow nozzle 66 communicating via its central bore 67 with chamber 62 for aspiration or suction intake of fluid into chamber 62 on outward movement of plunger 63 from cylinder 61, e.g. when nozzle 66 is flow connected to adapter 80, and for pressure dispensing of fluid from chamber 62 on inward movement of plunger 63 into cylinder 61, e.g. when nozzle 66 is later flow connected to an injection needle (not shown) for administrating liquid L to a patient.

For this purpose, nozzle 66 is formed as a counterpart nozzle that mates with adapter nozzle 89, and has an annular recess 68 coaxial to bore 67 and containing a counterpart lock connector formed by internal luer lock 69 that mates and releasably locks with adapter luer lock 45. Recess 68 is formed so that bore 67 outwardly ends in a tubular tip 70 defining a mechanical contact probe. Nozzle 66 may have a cap 71 to preserve syringe 60 in sterile condition.

Figure 2:
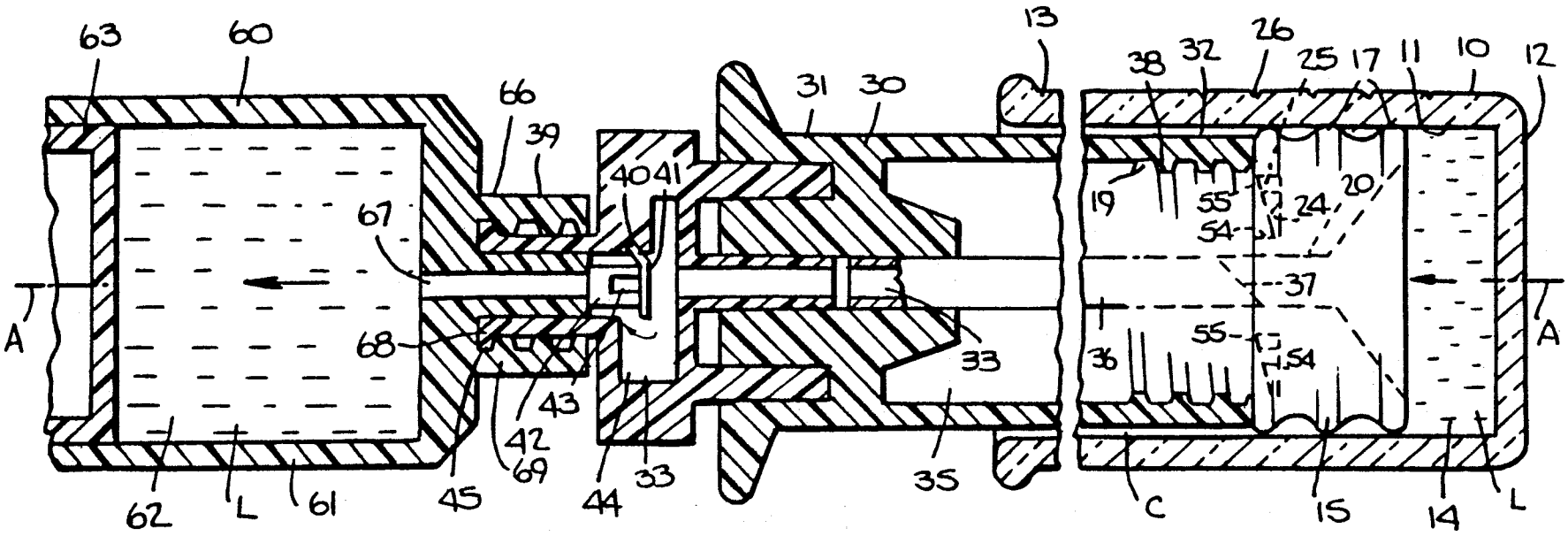
FIG. 2 is a schematic view of the assembly and device of FIG. 1, showing the parts connected to each other for suction transfer of liquid from the vial via the adapter to the syringe.

Syringe nozzle 66 is connected to adapter nozzle 39 by rotating insertion of adapter luer lock 45 onto syringe luer lock 69 in recess 68 to interlock locks 89 and 69, thereby also flow connecting syringe bore 67 with adapter flow path 88 and mechanically opening check valve 40 as probe 70 contacts valve nose 42 of the valve 40 and urges valve nose 42 to unseat diaphragm 41 from its closed position shown in FIG. 1 to open position shown in FIG. 2.

Assembly 1, formed of vial 10 filled with liquid L and closed by stopper 15, protected by end cap 23, and of adapter 30, protected by end caps 52 and 53, may be provided in unassembled sterile condition in a sterilely packaged kit K (shown in phantom in FIG. 1), prepared under suitable safeguards and controlled conditions at &he point of manufacture Optionally, syringe 60, protected by end cap 71, may be included therewith as a composite sterilely packaged kit K' (shown in phantom in FIG. 1).

At the end point of use, e.g. on recovering the components from such a kit K or K', cap 23 is removed from vial open end 13 and cap 52 is removed from adapter rear end 82, rear end 32 is inserted into open end 18 and rotated to engage adapter threads 38 with stopper threads 19 and adapter ratchets 54 with stopper ratchets 24, to cause adapter needle 36 to enter stopper bore 20 and needle tip 37 to penetrate seal 21, and adapter bosses 55 to snap-lock in recesses 25, thereby generally permanently rigidly locking and flow connecting adapter 30 to stopper 15 FIG. 2).

Needle tip 87 is recessed in socket 85 at least slightly inwardly from rear end 32, so that adapter 80 may be safely manipulated to fasten it on stopper 15 without danger of needle tip 37 puncturing the user. Needle tip 37 is positioned relative to threads 38, whereby on fastening threads 38 to threads 19, needle tip 37 will penetrate seal 21 and protrude slightly therebeyond in bore 20 but will not enter chamber 14.

Adapter 30 is sized relative to vial inside wall 11 for insertion of rear end 32 into vial 10 with a slight clearance C therebetween, since adapter 30 is not connected to vial 10, but rather to stopper 15, and in permanent rigid manner. Thus, slight radial movement of adapter 30 relative to vial 10 may be accommodated, as stopper 15 is desirably made of pliable or resilient, e.g. rubber, material, which insures a tight slidably sealing fit between its seal rings 17 and vial inside wall 11, in the manner of a piston-cylinder arrangement, yet permits adjustment between adapter 30 and vial 10 at clearance C.

Since valve 40 is a check valve, no leakage of liquid L can occur thereat on penetrating stopper seal 21 by adapter needle tip 37. Also, as adapter flow path 33, including chamber 44 and needle 36, and stopper bore 20, are collectively of very small volume, and as vial chamber 14 is free from air spaces and at an internal pressure equal to external atmospheric pressure, any air in flow path 33 and bore 20 is negligible and will not disturb the atmospheric pressure condition in chamber 14.

Syringe 60, e.g. on recovery from kit K', may be connected to assembled vial 10, stopper 15 and adapter 30, by removing its end cap 71, inserting adapter nozzle 89 into recess 68 of syringe nozzle 66, and rotating these parts until adapter luer lock 45 is locked onto syringe luer lock 69 and syringe probe 70 is simultaneously inserted into adapter nozzle 89 to contact and shift valve nose 42 to raise diaphragm 41 to open position. Outward movement of plunger 63 from cylinder 61 aspirates a selective dosage of liquid L into syringe chamber 62 by suction withdrawal from vial chamber 14 via adapter flow path 83, passing outwardly around diaphragm 41 and inwardly through apertures 43 of nose 42 to reach syringe bore 67, as shown by the arrows in FIG. 2.

At the same time, a vacuum is created in vial chamber 14, causing vial 10 to shift toward syringe 60 on stopper 15 and increasingly onto adapter 30 by simultaneous compensating movement longitudinally relative to stopper 15 under external atmospheric pressure that reduces the volume of chamber 14 by an amount equal to the volume of liquid L transferred to syringe 60. Vial chamber 14 always remains at an internal pressure generally equal to external atmospheric pressure and its reduced volume always remains free from air spaces. Vial 10 moves in unison with plunger 63 and stops immediately when plunger 68 stops.

The arrangement of vial 10, stopper 15, adapter 30 and syringe 60, and their pertinent parts, at the end point of use, is favorably coaxial relative to a common central axis A, yet since these components are of hand held size and used to administer comparatively small dosages of liquid L, the overall length of the interconnected components is relatively short (FIG. 2). Advantageously, vial 10, stopper 15 and adapter 30 are of generally cylindrical shape and coaxially arranged, with needle 36 centrally located in adapter 80 in alignment with stopper bore 20 and adapter threads 88 in alignment with stopper threads 19.

Due to the maintaining of chamber 14 completely filled with liquid L and substantially free from air spaces, and the compensating volume reduction of chamber 14 as syringe 60 withdraws a selective liquid dosage therefrom, the interconnected arrangement of the components may be in any spatial orientation during liquid transfer, i.e. upright, inverted or at any angular position, without disturbing the transfer, as its internal system is at the same pressure as external atmospheric pressure, and formation of a saturated vapor of the liquid therein is prevented.

On disconnecting syringe nozzle 66 from adapter nozzle 39, cap 53 may be placed on nozzle 39 and a standard injection needle or other implement mounted on nozzle 66 to administer the syringe dosage to the patient. As check valve 40 simultaneously self-closes on removing syringe probe 70 from contact with nose 42, leakage of liquid L from adapter nozzle 39 is safely prevented.

For the next dosage, the above operation is repeated, with the same or a different syringe 60 connected to adapter 30 to transfer from vial 10 an amount of liquid L corresponding to that dosage, resulting in the further shifting of vial 10 on stopper 15 by a compensating increment to reduce the volume of chamber 14 by a like amount to that of the liquid volume withdrawn.

A main advantage of the invention is that the hazardous liquid L is prepared, filled into vial 10 and closed by stopper 15, under controlled conditions at the point of manufacture which safeguard against leakage or other mishap and enable the liquid to be sealed by stopper 15 substantially free from attendant air spaces or pockets in chamber 14 that would foster a saturated hazardous vapor condition, lead to non-uniform pressure in chamber 14 on aspirating liquid dosages from Vial 10 at the end point of use, and expose the environment and user to the danger of hazardous liquid leakage, e.g. in aerosol or droplet form.

Instead, on aspirating liquid L from vial 10, the internal pressure in chamber 14 always remains generally equal to external atmospheric pressure, and the concordant volume reduction of chamber 14 by compensating shifting of vial 10 on stopper 15 insures that chamber 14 will remain free from air spaces and at uniform internal pressure and thus inhibit aerosol or droplet formation or leakage from nozzle 39, which advantageously is further inhibited by the presence of check valve 40 thereat. As adapter 30 is desirably permanently fastened to stopper 15, nozzle 39 constitutes the only leakage site of assembly 1, and leakage is avoided both by providing check valve 40 thereat and by automatically keeping chamber 14 at atmospheric pressure.

Forming adapter 30 as freely detachable from stopper 15, and stopper 15 as a self-sealing stopper are undesired, as this arrangement increases the possibility of leakage at the end point of use. It would also leave exposed needle tip 37 wet with residual liquid L, posing the danger of contaminating the environment or wetting or puncturing the skin of the user, even if cap 52 were remounted on adapter rear end 82, as this would contaminate the cap and repeat the danger of user contact with residual liquid L thereat on removing the cap to reconnect the adapter to the stopper to withdraw the next dosage from vial 10.

Use of a self-sealing stopper in nozzle 39 for penetration by a syringe needle, instead of check valve 40 and probe 70 containing nozzle 66, is also undesired, for like reasons.

Instead of mixing materials to form a hazardous solution at the end point of use where the conditions cannot be adequately controlled, e.g. per the aforesaid two Fournier et al patents, according to the invention the medicament is provided as a liquid formulated at the point of manufacture and the manipulations needed to charge the syringe at the end point of use are minimized as is the danger to the environment and user.

Although standard luer lock connectors as embodied by mating luer locks 45 and 69 are preferred, any suitable lock formations may be employed to interlock nozzles 39 and 69 to provide a sealed flow connection between adapter 30 and syringe 60.

Vial 10, stopper 15 and adapter 30 may be provided as disposable items, i.e. to be discarded as a still assembled unit per an authorized disposal procedure for hazardous materials, when the supply of liquid L in chamber 14 has been essentially completely withdrawn by the above described transfer operation.

The suction transfer of hazardous liquid contemplated by assembly 1 is safer than with conventional systems, as transfer is achieved in a completely closed arrangement, in which from start to finish the user is never exposed to an unprotected needle, nor to danger of leakage on disconnecting the syringe from the adapter, as the adapter has a check valve, and the liquid is always at atmospheric pressure in the assembly and syringe and will not spray forth from either disconnected nozzle. Since the disconnected syringe is needleless, it poses no danger of puncturing the user with a hazardous liquid containing needle.

The specification and drawings are set forth by way of illustration and not limitation, and various modifications may be made therein without departing from the spirit of the invention which is to be limited solely by the scope of the claims.

What is claimed is:

1. Suction transfer assembly for a medicament liquid comprising a vial forming an enclosed longitudinal chamber filled with a medicament liquid and having an open end closed by a penetrable stopper, the vial being slidable longitudinally relative to the stopper and the stopper slidably sealing the liquid in the chamber in any position of vial sliding movement, the stopper having fastening means facing the vial open end, and a longitudinal adapter having a front end, a rear end and an internal flow path extending therethrough, the rear end having a rearwardly facing hollow needle with a pointed tip defining the rear terminus of the flow path, and counterpart fastening means, the rear end being insertable into the vial open end to fasten the counterpart fastening means to the fastening means for fastening the adapter to the stopper, and to penetrate the stopper by the needle for flow connecting the chamber and flow path, and the front end having a forwardly facing hollow nozzle defining the front terminus of the flow path, a mechanical contact probe-openable and self-closing check valve in the flow path adjacent the nozzle, and a lock connector adapted to lock releasably to a counterpart lock connector on a separate suction operated dispenser device having a counterpart hollow nozzle containing a mechanical contact probe arranged for flow connection with the nozzle and for opening the valve, whereby on fastening the counterpart fastening means to the fastening means and penetrating the stopper by the needle, and locking the counterpart lock connector to the lock connector and flow connecting the counterpart nozzle with the nozzle and mechanically opening the valve by the contact probe, suction operation of the device will cause liquid transfer from the chamber via the adapter to the device and simultaneous compensating vial movement longitudinally relative to the stopper under external atmospheric pressure to reduce the chamber volume by an amount generally equal to the liquid transferred.

2. Assembly of claim 1 wherein the rear end has a socket containing the needle and the needle tip is located in the socket inwardly from the rear end.

3. Assembly of claim 2 wherein the counterpart fastening means are located in the socket.

4. Assembly of claim 3 wherein the counterpart fastening means and fastening means are coacting thread connection means.

5. Assembly of claim I wherein coacting separation inhibiting means are provided on the adapter and stopper to inhibit separation of the counterpart fastening means from the fastening means after fastening thereof.

6. Assembly of claim 1 wherein the lock connector is a luer lock connector.

7. Assembly o f claim I wherein the vial, stopper and adapter ar of generally cylindrical shape and coaxially arranged with the needle centrally located in the adapter.

8. Assembly of claim 1 wherein the liquid filled chamber is substantially free from attendant air spaces.

9. Assembly of claim i wherein the liquid filled vial closed by the stopper, and the adapter, are in unfastened condition in the form of a sterilely packaged kit.

10. Assembly of claim 1 including a separate suction operated dispenser device having a counterpart lock connector for locking releasably to the lock connector and a counterpart hollow nozzle containing a mechanical contact probe arranged for flow connection with the nozzle and for opening the valve.

11. Assembly of claim 10 wherein the device is a syringe.

12. Longitudinal adapter for transfer of a medicament liquid from a vial closed by a penetrable stopper to a suction operated dispenser device, the adapter having a front end, a rear end and an internal flow path extending therethrough, the rear end having a rearwardly facing hollow needle with a pointed tip defining the rear terminus of the flow path, and counterpart fastening means, the rear end being adapted to be inserted into the open end of a liquid filled vial closed by a penetrable stopper having fastening means facing the vial open end, to fasten the counterpart fastening means to the fastening means for fastening the adapter to the stopper, and to penetrate the stopper by the needle for flow connecting the vial liquid and flow path, and the front end having a forwardly facing hollow nozzle defining the front terminus of the flow path, a mechanical contact probe-openable and self-closing check valve in the flow path adjacent the nozzle, and a lock connector adapted to lock releasably to a counterpart lock connector on a separate suction operate dispenser device having a counterpart hollow nozzle containing a mechanical contact probe arranged for flow connection with the nozzle and for opening the valve.

13. Adapter of claim 12 wherein the rear end has a socket containing the needle and the needle tip is located in the socket inwardly from the rear end.

14. Adapter of claim 13 wherein the counterpart fastening means are located in the socket.

15. Adapter of claim 14 wherein the counterpart fastening means are thread connection means.

16. Adapter of claim 12 wherein the lock connector is a luer lock connector.

17. Adapter of claim 12 wherein the adapter is of generally cylindrical shape with the needle centrally located therein.

18. Method of using the assembly of claim 10 for essentially leakage free transfer of a selective volume of the medicament from the vial chamber via the adapter to the separate suction operated device, comprising the steps of (a) fastening the counterpart fastening means to the fastening means and penetrating the stopper by the needle to fasten the adapter to the stopper and flow connect the vial chamber and adapter flow path, (b) locking the counterpart lock connector to the lock connector to flow connect the counterpart nozzle With the nozzle and mechanically open the valve by the contact probe to flow connect the device with the adapter flow path, (c) transferring a selective volume of the liquid from the chamber into the device by suction operation of the device and simultaneously effecting compensating vial movement longitudinally relative to the stopper under external atmospheric pressure to reduce the chamber volume by an amount generally equal to the liquid transferred, and (d) disconnecting the device from the adapter by unlocking the counterpart lock connector from the lock connector with accompanying self-closing of the valve to prevent leakage from the nozzle.

19. Method of claim 18 wherein the liquid filled chamber is substantially free from attendant air spaces.

20. Method of claim 18 wherein steps (b), (c) and (d) are repeated to transfer a further selective volume of the liquid from the vial chamber to the device.

21. Method of claim 18 wherein the device is a syringe.

* * * * *